US006846332B2

(12) United States Patent
Boissie et al.

(10) Patent No.: US 6,846,332 B2
(45) Date of Patent: Jan. 25, 2005

(54) BLEACH STABILIZER FOR STAIN REMOVAL PEN

(75) Inventors: Stephane Boissie, Brussels (BE); Ulrich Kleinsteuber, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 48 days.

(21) Appl. No.: 09/884,310

(22) Filed: Jun. 19, 2001

(65) Prior Publication Data

US 2003/0019046 A1 Jan. 30, 2003

(51) Int. Cl.[7] ..... D06L 3/02; B43K 5/00

(52) U.S. Cl. ..... 8/111; 510/292; 510/293; 510/294; 510/295; 510/298; 510/372; 510/376; 401/198

(58) Field of Search ..... 401/198; 510/283, 510/284, 372, 376, 292, 293, 294, 295, 298, 111

(56) References Cited

U.S. PATENT DOCUMENTS

| | | | | |
|---|---|---|---|---|
| 3,748,268 | A | | 7/1973 | Loudas |
| 3,953,753 | A | | 4/1976 | Barrett |
| 4,273,661 | A | | 6/1981 | Grey |
| 4,842,762 | A | | 6/1989 | Sabol, Jr. et al. |
| 4,900,468 | A | * | 2/1990 | Mitchell et al. |
| 4,911,860 | A | | 3/1990 | Van Den Brom |
| 5,122,158 | A | | 6/1992 | Kuroda et al. |
| 5,259,848 | A | | 11/1993 | Terry et al. |
| 5,284,597 | A | | 2/1994 | Rees |
| 5,288,420 | A | | 2/1994 | Mandy |
| 5,324,131 | A | | 6/1994 | Gardner, III |
| 5,370,919 | A | | 12/1994 | Fieuws et al. |
| 5,611,687 | A | | 3/1997 | Wagner |
| 5,662,827 | A | | 9/1997 | Steiger et al. |
| 5,728,669 | A | | 3/1998 | Tyerech |
| 5,731,276 | A | | 3/1998 | Argo et al. |
| 5,765,407 | A | | 6/1998 | Choo et al. |
| 5,872,090 | A | | 2/1999 | You et al. |
| 5,895,504 | A | | 4/1999 | Sramek et al. |
| 6,048,368 | A | | 4/2000 | Tcheou et al. |
| 6,074,705 | A | | 6/2000 | DeBaene |
| 6,283,933 | B1 | | 9/2001 | D'Alessio et al. |
| 6,294,511 | B1 | | 9/2001 | Argo et al. |
| 6,386,781 | B1 | | 5/2002 | Gueret |
| 6,551,000 | B2 | | 4/2003 | Kandasamy et al. |
| 6,644,879 | B2 | | 11/2003 | Irvin et al. |
| 2002/0090251 | A1 | | 7/2002 | Sandbach et al. |
| 2002/0091070 | A1 | | 7/2002 | Englisch et al. |
| 2002/0178511 | A1 | | 12/2002 | Goldoni et al. |
| 2002/0198126 | A1 | | 12/2002 | Irvin et al. |
| 2003/0019046 | A1 | | 1/2003 | Boissie et al. |

FOREIGN PATENT DOCUMENTS

| | | | |
|---|---|---|---|
| DE | 24 22 191 | | 11/1975 |
| DE | 195 36 714 | | 4/1997 |
| DE | 195 36 714 | A1 | 4/1997 |
| DE | 198 22 391 | A1 | 11/1999 |
| EP | 0 157 653 | A2 | 10/1985 |
| EP | 0 157 853 | | 10/1985 |
| EP | 0 205 999 | | 12/1986 |
| EP | 0 209 228 | A1 | 1/1987 |
| EP | 0 266 200 | | 5/1988 |
| EP | 0 318 470 | | 5/1989 |
| EP | 0 205 999 | B1 | 3/1992 |
| EP | 0 905 223 | A1 | 3/1999 |
| EP | 0 905 225 | A1 | 3/1999 |
| GB | 1-016 053 | | 1/1966 |
| JP | 10099769 | | 4/1998 |
| WO | WO 85/00782 | | 2/1985 |
| WO | WO 93/01348 | | 1/1993 |
| WO | WO 95/34630 | | 12/1995 |
| WO | WO 97/02331 | | 1/1997 |
| WO | WO 97/20099 | | 6/1997 |
| WO | WO 98/11191 | | 3/1998 |
| WO | WO 98/17771 | | 4/1998 |
| WO | WO 99/02769 | | 1/1999 |

OTHER PUBLICATIONS

Heimac Stain Eraser—Instant Spot Remover (Product Label) Heimac Products Corporation, Alpharetta, GA, no date available.

McCrea, Bridget—"The Orange Glo Story"—Response Magazine, The Voice of the Electronic Retailing Association—Dec., 2001.

www.folex.net/index. html—"Folex Instant Carpet Spot Remover"—Sep. 10, 2002.

Google Search / Folox Carpet Cleaner—Sep. 10, 2002.

Google Groups / Newsgroups, Jan. 12, 1996—Tomato Soup Stain Removal from Carpet.

* cited by examiner

*Primary Examiner*—Margaret Einsmann
(74) *Attorney, Agent, or Firm*—Julia A. Glazer; Armina E. Matthews; Thibault Fayette

(57) ABSTRACT

The present invention relates to an applicator for a fabric treatment composition and its application. More specifically the invention relates to a convenient to carry fabric treatment applicator comprising a chelating agent and a radical scavenger and preferably a bleach, which allows for gentle fabric treatment which does not require post-treatment, like rinsing. Claimed and described is a fabric treatment applicator comprising an application device and a fabric treatment composition, the fabric treatment composition comprising a radical scavenger and a chelating agent. Further claimed and described is the use of a fabric treatment composition comprising a radical scavenger and a chelating agent for no rinse fabric treatment.

5 Claims, No Drawings

BLEACH STABILIZER FOR STAIN REMOVAL PEN

FIELD OF THE INVENTION

The present invention relates to an applicator for a fabric treatment composition and its application. More specifically the invention relates to a convenient to carry fabric treatment applicator comprising a chelating agent and a radical scavenger and highly preferably a bleach, which allows for gentle fabric treatment which does not require post-treatment, like rinsing.

BACKGROUND OF THE INVENTION

Portable stain removers for pre-laundry application, post laundry application or application on fresh stains, also in forms of applicators for a liquid composition are known articles of manufacture. Similarly, portable applicators for the application of other liquid compositions are known, for example in the field of ink removal. Prior art in this field includes the following documents:

U.S. Pat. No. 5,288,420 discloses a stain removal composition provided in form of a solid stick, which can be applied to selected areas of a fabric in laundry preparations. Various compositions are disclosed comprising surfactants, enzymes and glycols. U.S. Pat. No. 3,748,268 discloses a stain removal composition especially for carpets and upholstery comprising surfactant for an aerosol formulation. EP 0 205 999 discloses to provide a laundry preparation composition in the form of a solid stick. WO 85/00782 discloses a kit comprising coloured fluids and an eradicator for these fluids, which can be used on various materials including clothing. DE 2422191 discloses a solution to be used on stains provided in an applicator with a felt insert. DE 19536714 discloses an applicator for a stain removal fluid which takes the form of a pen. WO 99/02769 discloses an impregnated towelette to clean stains from clothes and upholstery, comprising surfactant.

Applicators comprising bleach are known in other fields than fabric treatment: U.S. Pat. No. 5,324,131 discloses an applicator for a liquid bleaching agent to be used to eradicate or remove an emphasising ink. The applicator may be provided with a felt tip or roller. U.S. Pat. No. 5,611,687 discloses an oral fluid, e.g. for the teeth or the gum, and an applicator for it comprising a broad fibre tip or a roller ball.

None of the above patents gives details how the various applicators should be used. Prior art documents which address the application of the respective compositions with some detail include the following documents:

U.S. Pat. No. 5,765,407 describes an on-the-spot stain removal kit, comprising four sponges, and teaches a four step stain removal procedure for satisfactory results.

U.S. Pat. No. 5,122,158 discloses an applicator for an enzyme-containing liquid detergent for the application in laundry preparation. The applicator comprises a porous body made of a synthetic plastic material. The heat resulting from the friction produced by the applicator during application to a fabric is assumed to contribute to a more rapid enzymatic reaction.

WO 97/20099 discloses an applicator for the post-laundry treatment of fabrics. A two step process is taught which involves the use of an iron on one side of the fabric and the use of an absorbent layer on the other side of the fabric. The application of heat and/or pressure by means of an iron is believed to affect the physical characteristics of the stained fabric, such as its viscosity.

U.S. Pat. No. 5,872,090 discloses a stamp like applicator for a fabric treatment composition comprising bleach and surfactant, which is to be applied to a fabric in a rocking motion. The treatment is preferably done on a table top and preferably using an absorbent stain remover situated beneath the fabric and followed by a post-treatment process in a hot air cloth dryer. A rubbing action as opposed to a rocking action is expressly taught to be of disadvantage as to minimise fabric damage.

The Helmac Stain Eraser, as marketed on the internet by the Helmac Products Corporation, incorporates a plastic tip for rubbing. The device according to the usage instructions is not recommended for use on silk, suede or leather. A stain removal treatment with this device further requires a post-treatment step of removing the stain or residues of the fabric treatment liquid by rinsing the stain away with water or blotting with a moist cloth.

While not common in the field of stain removal applicators, in other fields of fabric treatment the use of bleach is quite common and bleaches are found in washing powders as well as in liquid laundry detergents. For example, WO 97/02331, discloses a peroxide bleach, which comprises a radical scavenger and which additionally may comprise a chelating agent. However, the disclosed components are provided only for the pre-treatment of laundry and require a post-treatment by washing or at least rinsing. WO 98/11191 discloses a peroxygen bleach comprising ATMP and the enhancement of the pre-treatment process with this bleach by rubbing two pieces of fabric against each other or using a brush or a sponge in this process.

There is a number of drawbacks associated with the prior art in this field:

Fabric treatment applicators for removal of stains have so far not exploited the benefits of using bleach, in particular for the removal of commonly occuring stains of relatively dark colour, e.g. from blood, grass or red wine.

Fabric treatment using bleach on the other hand was so far typically a multiple step treatment, therefore inconvenient, not easily restrictable to a pre-selected portion of a fabric and hence unsuitable for stain removal.

It is an objective of the present invention to provide an applicator for a fabric treatment composition, which allows effective mechanical stain removal.

It is a further objective of the present invention to provide an applicator for a fabric treatment composition, which allows single step application.

It is still a further objective of the present invention to provide an applicator for a fabric treatment composition, which does not leave residues or induces fabric damage even when no rinsing or other post-treatment of the fabric is undertaken.

It is yet a further objective of the present invention to provide an applicator for a fabric treatment composition, which is easy to use.

It is another objective of the present invention to provide an applicator for a fabric treatment composition, which is safe and convenient to store and to carry.

It is an additional objective of the present invention to provide an applicator for a fabric treatment composition, which can be successfully used on a large variety of stains and fabrics.

It is still an additional objective of the present invention to provide an applicator for a fabric treatment composition which can be safely used on delicate and coloured fabrics and which is colour safe (hence not removing dyes).

These and other objectives, as apparent from the following description, are addressed by the present invention.

SUMMARY OF THE INVENTION

The present invention relates to an applicator for a fabric treatment composition and its application. More specifically the invention relates to a convenient to carry fabric treatment applicator comprising a chelating agent and a radical scavenger and preferably a bleach, which allows for gentle fabric treatment, namely without dye fading, and which does not require post-treatment, like rinsing. Claimed and described is a fabric treatment applicator comprising an application device and a fabric treatment composition, the fabric treatment composition comprising a radical scavenger and a chelating agent. Further claimed and described is the use of a fabric treatment composition comprising a radical scavenger and a chelating agent for no rinse fabric treatment.

DETAILED DESCRIPTION OF THE INVENTION

In accordance with the present invention a fabric treatment applicator is provided comprising a fabric treatment composition which comprises a chelating agent and a radical scavenger and preferably also a bleach. While the addition of a chelating agent and a radical scavenger have been found to increase the cleaning performance of the fabric treatment applicator also in absence of a bleach, they further have been found to be useful to stabilise the bleach. Most preferably the fabric treatment composition comprises a bleach and a surfactant as specified hereinafter.

While a fabric treatment composition according to the present invention can be used and applied in any manner, the composition is preferably applied with an applicator described hereinafter and most preferably with an applicator comprising a nib.

Moreover the fabric treatment composition according to the present invention allows for no rinse single step fabric treatment even on delicate fabrics. Preferred methods of use are also further described hereinafter.

Preferred Compositions

Any composition comprising a radical scavenger and a chelating agent and which can be used for fabric treatment is within the scope of the present invention. Preferred are fabric friendly compositions, in particular stain removal compositions as described below.

Rinsing, as used herein, refers to a post-treatment step following the stain removal step as part of one fabric treatment procedure. For example, rinsing encompasses rinsing as part of a washing-cycle in a washing machine, rinsing as part of a hand-washing procedure after treatment with a washing detergent (which may comprise a bleach) and rinsing after treatment with a bleach, e.g. by soaking a whole garment. While a whole garment may be subjected to rinsing, rinsing may also be a localised treatment of only a portion of a garment. No rinse fabric treatment, as used herein, refers to fabric treatment without any of the above mentioned rinsing steps.

Preferred fabric treatment methods according to the present invention work well without that a whole garment is subjected to rinsing, but even more preferred fabric treatment methods do work well without any localised post-treatment with any fluid, e.g. treatment with a moist cloth and any localised application of water, a solvent and the like. Most preferred no rinse.

Preferred fabric treatment compositions are compositions which do not leave visible residues on a treated fabric when the fabric is not rinsed. Residues are considered not visible, when they receive a rating of less than 2.5 panel score unit in the Residue Test Method described below. Preferred no rinse fabric treatment composition afford a rating of less than 1.5, more preferably less than 1.0, yet more preferably less than 0.5 panel score units.

Without wishing to be bound by theory it is believed that the preservation of bleach comprised by the fabric treatment composition is particularly critical for avoiding dye removal. Moreover it is believed that chelating agents and in particular the chelating agents listed herein are helpful in stabilizing bleaches and in particular oxygen based bleaches. However, it is believed that the chelating agents may not fully prevent the disintegration of bleaches, but that the presence of radical scavengers, and preferably the radical scavengers listed herein, helps to inactivate disintegrated components of bleaches, which are believed to be mostly radicals, and to block the propagation of bleach decomposition, and hence to prevent fabric damage or dye removal by such disintegrated bleach components.

Further it is believed that the preservation of the bleach is also critical to avoid gas build-up inside the fabric treatment applicator. Chelating agents and radical scavenger are believed to prevent the bleach from decomposing into water and oxygen gas, which therefore reduces the risk of gas build-up and possible oxidation of parts of the fabric treatment applicator. Oxidation is particularly critical for metal parts of the applicator. Metal parts may be present in the application device or in flow interruption means, such as a valve comprising a metal spring. Moreover the gas-build up itself may affect the controlled delivery of the fabric treatment composition or may even become a safety hazard.

While the fabric treatment compositions disclosed herein may have very different pH values, an acidic pH value is preferred, a very preferred pH range being from 4 to 6, most preferably 4.5 to 5.5. It is believed that the preferred pH values help to stabilize bleach by preventing its decompostion, and therefore further hence to prevent fabric damage.

One problem associated with known fabric treatment compositions hereinafter referred to as stain removal compositions is their tendency to leave visible residues on fabric surfaces. Such residues are problematic and are preferably to be avoided herein since the present process does not involve conventional immersion or rinse steps. Accordingly, the stain removal compositions herein should, most preferably, be substantially free of various polyacrylate-based emulsifiers, polymeric anti-static agents, inorganic builder salts and other residue-forming materials, except at low levels of 0.1%–0.3%, and preferably 0%, of the final compositions (%, as used herein, denotes % by weight of 100% active). Water used in the compositions should preferably be distilled, deionized or otherwise rendered free of residue-forming materials.

Accordingly, in a preferred aspect of this invention there are provided stain removal compositions which are substantially free of materials which leave visible residues on the treated fabrics. This necessarily means that the preferred stain removal compositions are formulated to contain a high level of volatile materials, preferably water, preferably 95%, a cleaning solvent such as BPP at a low, but effective, level, typically 1% to 4%, preferably 2%, hydrogen peroxide at a level from 1% to 3%, preferably 2%, and surfactant at levels of 0.1% to 1%. Advantageously, when thus formulated such compositions exist as phase-stable aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, the chemical compositions which are used to provide the stain removal and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. The preferred compositions herein are formulated to minimize or avoid these problems.

The dye removal attributes of the present compositions can be compared with art-disclosed cleaners using photographic or photometric measurements, or by means of a simple, but effective, visual grading test, the dye removal test described below.

In addition to the foregoing considerations, the compositions used herein are preferably formulated such that they are easily dispensed and not so viscous or self-adhesive in nature that they render the stain removal applicator unhandy or difficult to use. Preferably the fabric treatment compositions described herein are formulated as liquid fabric treatment compositions. In one alternative they may be provided as a gel. A stain removal composition according to the present invention comprises:

(a) Bleach—The compositions herein comprise from 0% to 99.99%, preferably 0.001% to 7%, by weight, of bleach, preferably peroxide bleach, most preferably hydrogen peroxide. More preferred spot cleaners will comprise 0.5% to 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Surfactant—The compositions herein comprise from 0% to 99.99%, preferably 0.05% to 5%, more preferably 0.05% to 2% by weight of surfactants, such as ethoxylated alcohols or alkyl phenols, alkyl sulfates, NaAES, NH4AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP and 0.3% AES. Also, nonionics such as the ethoxylated C10–C16 alcohols, e.g., NEODOL 23-6.5, can be used in the compositions. The alkyl sulfate surfactants which may be used herein as cleaners and to stabilize aqueous compositions are the C8–C18 primary ("AS"; preferred C10–C14, sodium salts), as well as branched-chain and random C10–C20 alkyl sulfates, and C10–C18 secondary (2,3) alkyl sulfates of the formula CH3(CH2)x(CHOSO3-M+) CH3 and CH3 (CH2)y(CHOSO3-M+) CH2CH3 where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula R(EO) xSO3Z, wherein R is C10–C16 alkyl, EO is —CH2CH2—O—, x is 1–10 and can include mixtures which are conventionally reported as averages, e.g., (EO)2.5, (EO)6.5 and the like, and Z is a cation such as sodium ammonium or magnesium (MgAES). The C12–C16 alkyl dimethyl amine oxide surfactants can also be used.

(c) Solvent—The compositions herein may comprise from 0% to 99.99% preferably from 0% to 10% by weight, of butoxy propoxy propanol (BPP) solvent or other solvents as described herein. Organic solvents are preferred for use in the present compositions. Preferred spot cleaners will comprise 1–4% BPP which is available in commercial quantities as a mixture of isomers in about equal amounts. The isomers, and mixtures thereof, are useful herein. The isomer structures are as follows:

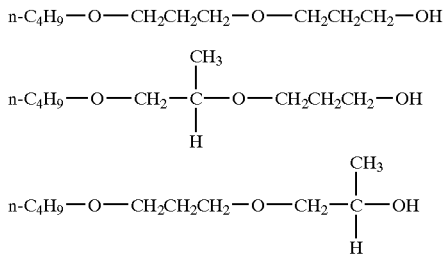

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

(d) Water—The preferred, low residue compositions herein may comprise from 0% to 99.99%, preferably from 70% to 99.99%, more preferably 90% to 99.9%, most preferably from 94.0% to 99.0%, by weight, of water and hence are preferably aqueous solutions. Water used in the compositions should preferably be distilled, deionized or otherwise rendered free of residue-forming materials.

(e) Chelating Agents

The compositions of the present invention comprise a chelating agent, herein also referred to a chelating agent. Typically, the compositions according to the present invention comprise up to 5% by weight of the total composition of a chelating agent, or mixtures thereof, preferably from 0.01% to 1.5% by weight and more preferably from 0.01% to 0.5%.

Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, citric acids or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

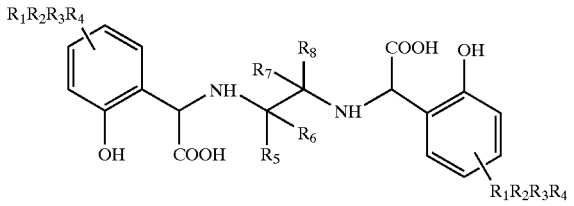

wherein R1, R2, R3, and R4 are independently selected from the group consisting of —H, alkyl, alkoxy, aryl, aryloxy, —Cl, —Br, —NO2, —C(O)R', and —SO2R"; wherein R' is selected from the group consisting of —H, —OH, alkyl, alkoxy, aryl, and aryloxy; R" is selected from the group consisting of alkyl, alkoxy, aryl, and aryloxy; and R5, R6, R7, and R8 are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Preferred chelating agents are also those often referred to as organic stabilizers. The compositions herein may also optionally contain organic stabilizers for improving the chemical stability of the composition, provided that such materials are compatible or suitably formulated. Organic stabilizers can be selected from the following group: monophenols such as 2,6-di-tert-butylphenol or 2,6-di-tert-butyl-4-methylphenol; diphenols such as 2,2'-methylenebis (4-methyl-6-tert-butylphenol) or 4,4'-methylenebis(2,6-di-tert-butylphenol); polyphenols such as 1,3,5-trimethyl-2,4,6-tris(3',5'-di-tert-butyl-4-hydroxybenzyl)benzene; hydroquinones such as 2,5-di-tert-amylhydroquinone or tert-butylhydroquinone; aromatic amines such as N-phenyl-N'-(1,3-dimethylbutyl)-p-phenylenediamine or N-phenyl-α-napthylamine; dihydroquinolines such as 2,2,4-trimethyl-1,2-dihydro-quinoline; ethane-1-hydroxy-1,1-diphosphonate and other known phosphonates (see, for example, U.S. Pat. Nos. 3,159,581; 3,213,030; 3,422,021; 3,400,148 and 3,422,137), and mixtures thereof.

Organic stabilizers are typically used in the present compositions at levels from 0.01% to 5.0%, more preferably from 0.05% to 0.5%.

The peroxygen bleach-containing compositions according to the present invention may further comprise from 0.5% to 5%, preferably from 2% to 4% by weight of the total composition of an alcohol according to the formula HO—CR'R"—OH, wherein R' and R" are independently H or a C2–C10 hydrocarbon chain and/or cycle. Preferred alcohol according to that formula is propanediol.

(f) Radical Scavenger

The compositions of the present invention comprise a radical scavenger or a mixture thereof. Radical scavengers are typically present herein in amounts ranging from up to 10% by weight of the total composition and preferably from 0.001% to 0.5% by weight.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid and derivatives thereof, like alkoxylated benzoic acids, as for example, trimethoxy benzoic acid (TMBA), toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

The presence of radical scavengers may contribute to reduce tensile strength loss of fabrics and/or color damage when the compositions of the present invention are used in any laundry application, especially in a laundry pretreatment application.

(g) Other Optionals—The compositions herein may comprise minor amounts of various optional ingredients, including enzymes, preservatives, anti-static agents, fragrances, odor absorbing components, and the like. If used, such optional ingredients will typically comprise from 0.0001% to 10%, more preferably from 0.01% to 2%, by weight, of the compositions, having due regard for residues on the cleaned fabrics. Preferred optionals are namely the following:

Enzymes—Besides the optional surfactants in the stain removal compositions herein can contain enzymes to further enhance cleaning performance. Lipases, amylases and protease enzymes, or mixtures thereof, can be used. If used, such enzymes will typically comprise from 0.001% to 5%, preferably from 0.01% to 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

Preservatives—The compositions herein can optionally be preserved for storage using conventional preservatives such as KATHON® at a level of 0.0001%–1%, by weight.

Anti-Static Agents—If an antistatic benefit is desired, the compositions used herein can contain an anti-static agent. If used, such anti-static agents will typically comprise at least 0.5%, typically from 2% to 8%, by weight, of the compositions. Preferred anti-stats include the series of sulfonated polymers available as VERSAFLEX 157, 207, 1001, 2004 and 7000, from National Starch and Chemical Company.

Fragrances—The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from 0% to 0.5%, preferably from 0.003% to 0.3%, more preferably from 0.005% to 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Odor Absorbing Components—The compositions of the present invention may further comprise an optional cyclodextrin. This will impart the composition with odour absorbing properties, which is especially useful for application on inanimate surfaces to control the malodour.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

Fabric Protection Agent

As the fabric protection agent, the compositions herein comprise ATMP, i.e. the compound of formula:

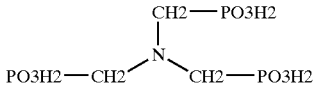

Preferably, the compositions herein will comprise from about 0.005% to about 5.0%, more preferably from about 0.01% to about 1.0%, by weight of the total bleaching composition of ATMP.

Optional Bleach Activators—The peroxygen-containing compositions herein may optionally, but preferably, further comprise a bleach activator. By bleach activator, it is meant herein a compound which reacts with hydrogen peroxide to form a peracid. The peracid thus formed constitutes the activated bleach. Particularly preferred is acetyl triethyl citrate. Said bleach activators, if present, will typically comprise from about 0.5% to about 20%, preferably from 2% to 10%, most preferably from 3% to 7%, by weight of the total composition.

Bleach activators suitable herein are any known activators typified by NOBS (nonanoyl oxybenzenesulfonate), TAED (tetraacetylethylenediamine), or ATC (acetyl triethyl citrate). Numerous other bleach activators are known. See for example activators referenced in U.S. Pat. No. 4,915,854, issued Apr. 10, 1990 to Mao et al, and U.S. Pat. No. 4,412,934. See also U.S. Pat. No. 4,634,551 for other typical conventional bleach activators. Also known are amido-derived bleach activators of the formulae: R1N(R5)C(O)R2C(O)L or R1C(O)N(R5)R2C(O)L wherein R1 is an alkyl group containing from about 6 to about 12 carbon atoms, R2 is an alkylene containing from 1 to about 6 carbon atoms, R5 is H or alkyl, aryl, or alkaryl containing from about 1 to about 10 carbon atoms, and L is any suitable leaving group. Further illustration of bleach activators of the above formulae include (6-oct-anamidocaproyl)-oxybenzenesulfonate, (6-nonanamidocaproyl)oxybenzenesulfonate, (6-decanamidocaproyl)oxybenzenesulfonate, and mixtures thereof as described in U.S. Pat. No. 4,634,551. Another class of bleach activators comprises the benzoxazin-type activators disclosed by Hodge et al in U.S. Pat. No. 4,966,723, issued Oct. 30, 1990. Still another class of bleach activators includes acyl lactam activators such as substituted and unsubstituted benzoyl caprolactam, t-butylbenzoylcaprolactam, n-octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, undecenoyl valerolactam, nonanoyl valerolactam, 3,5,5-trimethylhexanoyl valerolactam, t-butylbenzoylvalerolactam and mixtures thereof.

Preferred bleach activators useful herein include those selected from the group consisting of acetyl triethyl citrate, n-octanoyl caprolactam, 3,5,5-trimethylhexanoyl caprolactam, nonanoyl caprolactam, decanoyl caprolactam, n-octanoyl valerolactam, 3,5,5-trimethylhexanoyl valerolactam, nonanoyl valerolactam, decanoyl valerolactam, nitrobenzoyl caprolactam, nitrobenzoyl valerolactam, and mixtures thereof. Particularly preferred are the bleach activators which are liquid or oil at room temperature. Examples of liquid bleach activators are acetyl triethyl citrate, n-octanoyl caprolactam, 3,5,5-trimethylhexanoyl caprolactam, nonanoyl caprolactam, decanoyl caprolactam, and mixtures thereof. The present compositions can optionally comprise aryl benzoates, such as phenyl benzoate, sodium pyrophosphate and sodium orthophosphate.

Builders—Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 0.1% builder.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulfonic acid, and carboxymethyloxysuccinic acid, the various alkali metal, ammonium and substituted ammonium salts of polyacetic acids such as nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance due to their availability from renewable resources and their biodegradability. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the C5–C20 alkyl and alkenyl succinic acids and salts thereof. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., C12–C18 monocarboxylic acids, can also be incorporated into the compositions alone, or in combination with the aforesaid builders, especially citrate and/or the succinate builders, to provide additional builder activity. Such use of fatty acids will generally result in a diminution of sudsing in laundry compositions, which may need to be be taken into account by the formulator.

Where phosphorus-based builders can be used, and especially in hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulfates, and aluminosilicates.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) C3 oxyalkylene terephthalate segments, wherein, if said hydrophobe components also comprise oxyethylene terephthalate, the ratio of oxyethylene terephthalate:C3 oxyalkylene terephthalate units is about 2:1 or lower, (ii) C4–C6 alkylene or oxy C4–C6 alkylene segments, or mixtures therein, (iii) poly (vinyl ester) segments, preferably polyvinyl acetate), having a degree of polymerization of at least 2, or (iv) C1–C4 alkyl ether or C4 hydroxyalkyl ether substituents, or mixtures therein, wherein said substituents are present in the form of C1–C4 alkyl ether or C4 hydroxyalkyl ether cellulose derivatives, or mixtures therein, and such cellulose derivatives are amphiphilic, whereby they have a sufficient level of C1–C4 alkyl ether and/or C4 hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy C4–C6 alkylene hydrophobe segments include, but are not limited to, end-caps of polymeric soil release agents such as MO3S(CH2)nOCH2CH2O—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of C1–C4 alkyl and C4 hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., C1–C6 vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

If utilized, soil release agents will generally comprise from about 0.01% to about 10.0%, by weight, of the detergent compositions herein, typically from about 0.1% to about 5%, preferably from about 0.2% to about 3.0%.

Further Optional Ingredients—Detersive ingredients or adjuncts optionally included in the instant compositions can include one or more materials for assisting or enhancing cleaning performance, treatment of the substrate to be cleaned, or designed to improve the aesthetics of the compositions. Such materials are further illustrated in U.S. Pat. No. 3,936,537, Baskerville et al. Adjuncts which can also be included in compositions of the present invention, in their conventional art-established levels for use (generally from 0% to about 20% of the detergent ingredients, preferably from about 0.5% to about 10%), include other active ingredients such as dispersant polymers from BASF Corp. or Rohm & Haas; anti-tarnish and/or anti-corrosion agents, dyes, fillers, germicides, hydrotropes, enzyme stabilizing agents, perfumes, solubilizing agents, clay soil removal/anti-redeposition agents, carriers, processing aids, pigments, solvents, fabric softeners, static control agents, etc.

Dye Transfer Inhibiting Agents—The compositions of the present invention may also include one or more materials effective for inhibiting the transfer of dyes from one dyed surface to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R-Ax-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

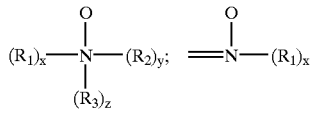

wherein R1, R2, R3 are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., Chemical Analysis, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

Suds Boosters—If high sudsing is desired, suds boosters such as C10–C16 alkanolamides can be incorporated into the compositions, typically at 1%–10% levels. The C10–C14 monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as MgCl2, MgSO4, and the like, can be added at levels of, for example, 0.1%–2%, to provide additional suds and to enhance grease removal performance.

Brightener—Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-naphthol[1,2-d] triazoles; 4,4'-bis-(1,2,3-triazol-2-yl)-stil-benes; 4,4'-bis (styryl)bisphenyls; and the aminocoumarins. Specific examples of these brighteners include 4-methyl-7-diethylamino coumarin; 1,2-bis(-benzimidazol-2-yl)ethylene; 2,5-bis(benzoxazol-2-yl)thiophene; 2-styryl-napth-[1,2-d]oxazole; and 2-(stilbene-4-yl)-2H-naphtho-[1,2-d] triazole. See also U.S. Pat. No. 3,646,015, issued Feb. 29, 1972 to Hamilton. Anionic brighteners are typically preferred herein.

Bleach Catalysts—If desired, compositions herein may additionally incorporate a catalyst or accelerator to further improve bleaching or soil removal. Any suitable bleach catalyst can be used. For detergent compositions used at a total level of from about 1,000 to about 5,000 ppm in water, the composition will typically deliver a concentration of from about 0.1 ppm to about 700 ppm, more preferably from about 1 ppm to about 50 ppm, or less, of the catalyst species in the wash liquor.

Typical bleach catalysts comprise a transition-metal complex, for example one wherein the metal coordinating ligands are quite resistant to labilization and which does not deposit metal oxides or hydroxides to any appreciable extent under the typically alkaline conditions of washing. Such catalysts include manganese-based catalysts disclosed in U.S. Pat. No. 5,246,621, U.S. Pat. No. 5,244,594; U.S. Pat. No. 5,194,416; U.S. Pat. No. 5,114,606; and EP Nos. 549, 271 A1, 549,272 A1, 544,440 A2, and 544,490 A1; preferred examples of these catalysts include MnIV2(μ-O)3(TACN)2-(PF6)2, MnIII2(μ-O)1(μ-OAc)2(TACN)2(ClO4)2, MnIV4(μ-O)6(TACN)4(ClO4)4, MnIIIMnIV4-(μ-O)1(μ-OAc)2-(TACN)2-(ClO4)3, MnIV-(TACN)-(OCH3)3(PF6), and mixtures thereof wherein TACN is trimethyl-1,4,7-triazacyclononane or an equivalent macrocycle; though alternate metal-co-ordinating ligands as well as mono-nuclear complexes are also possible and monometallic as well as di- and polymetallic complexes and complexes of alternate metals such as iron or ruthenium are all within the present scope. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Transition matals may be precomplexed or complexed in-situ with suitable donor ligands selected in function of the choice of metal, its oxidation state and the denticity of the ligands. Other complexes which may be included herein are those of U.S. application Ser. No. 08/210,186, filed Mar. 17, 1994.

A stain removal composition comprising a radical scavenger and a chelating agent and preferably a bleach is efficient in treating a large variety of stains. It is known that various greasy stains are best treated with a surfactant whereas other common stains such as from grass, tomato sauce or wine are best treated with bleach, while water soluble stains can normally effectively removed with water.

While referring to stain removal compositions, the compositions disclosed herein may also favourably be used in other contexts, for example for bleaching and/or sanitation of non-stained fabrics.

EXAMPLES OF STAIN REMOVAL COMPOSITIONS

Having due regard to the foregoing considerations, the following illustrates preferred examples of stain removal compositions, but is not intended to be limiting thereof.

Example 1

| | % (wt) of 100% active component formula range |
|---|---|
| BPP | 1.0–2.0 |
| Hydrogen peroxide | 1.5–3.0 |
| Alkyl sulfate surfactant | 0.3–1.0 |
| Perfume | 0.005–0.01 |
| Ethanol | 0.3–1.0 |
| BHT | 0.01–0.05 |
| citric acid | 0.03–0.1 |
| Water | Balance |

Example 2

| | % (wt) of 100% active component formula range |
|---|---|
| BPP | 1.0–2.0 |
| Hydrogen peroxide | 1.5–3.0 |
| LIPOLASE | 0.3–0.5 |
| Alkyl sulfate surfactant | 0.3–1.0 |
| Perfume | 0.005–0.01 |
| Ethanol | 0.3–1.0 |
| TMBA | .01–.05 |
| ssEDDS ® | 0.03–0.1 |
| Water | Balance |

Applicators

Any applicator comprising a fabric treatment composition and an application device is within the scope of the present invention. Preferred applicator according to the present invention comprise an application device which induces a certain friction upon the fabric, on which it is to be used. This largely helps efficient removal of a stain.

The application device, as used herein, is a device which in use is in contact with the surface on which the fabric treatment applicator is used and delivers the fabric treatment composition to that surface. Preferred application devices include any felt, non-woven material, sponge, or foam insert, for example in the form of a porous pad, and most preferably in the form of a nib. Another preferred application device is a roller ball. Other preferred application devices are all those used to apply a writing fluid to paper, e.g. as used in a fountain pen. For a wipe or towelette applicator the whole wipe or towelette is encompassed by the term application device. If the fabric treatment composition is provided in solid stick form, the whole solid stick is encompassed by the term application device. Applicators having only one application device, most preferably a nib are preferred.

Without wishing to be bound by theory it is believed that the performance of the application device with regard to stain removal is largely influenced by the friction induced by the application device upon a fabric. Again without wishing to be bound by theory it is believed that the frictional behaviour is best described in terms of frictional stress. The frictional stress value is defined as the force exerted upon a reference fabric per unit area of real contact and is measured as given below.

The frictional stress of an application device is of particular importance as it is an indicator of the efficiency with which the mechanical energy provided by the user is transferred to the fabric to abrade a stain and/or deliver the fabric treatment composition onto and into any chosen area of the fabric. When an application device is inefficient, as indicated by a low frictional stress value, the energy supplied by the user is dissipated in other ways, for example, through the application device itself deforming or tearing.

The frictional stress of an application device, σ, is defined as:

$$\sigma = \frac{F}{A} = \frac{\mu R}{A}$$

where F is the frictional force, A the contact area, $\mu$ the coefficient of friction and R the reaction to the normal load. Frictional stress values, as measured in the method detailed below, of greater than 0.05 N $mm^{-2}$ have been shown to be advantageous, more preferably the frictional stress values are from 0.05 N $mm^{-2}$ to 10 N $mm^{-2}$, yet more preferably from 0.1 N $mm^{-2}$ to 1 N $mm^{-2}$ and most preferably from 0.2 N $mm^{-2}$ to 0.4 N $mm^{-2}$.

Generally all applicators are within the scope of the present invention. The choice of a particular applicator will largely depend on the usage envisaged. For example a wipe or a towelette applicator providing the desired frictional stress may be chosen. Such wipes or towelette may be packaged individually or a plurality of them may be packaged together. Preferably such package prevents evaporation of the compositions disclosed herein.

Preferred applicators comprise a housing comprising a reservoir for the storage of a composition. Such a housing may be a bottle of any shape or size. Preferred shapes for such housings are hollow barrel shapes, most preferably having a diameter to length ratio from 1:30 to 1:2, so as to be convenient to hold in the user's hand, use and store. More preferred are housings of a diameter to length ratio from 1:20 to 1:5, which resemble in shape a pen, e.g. a ball pen or a highlighter pen, and which are herein referred to as pen-shaped. The reservoir may be filled with an absorbent material, such as a wadding or a cartridge style device such as those commonly found in ink pens able to release liquid on demand. The housing may be made of any solid material, which may also be flexible, such as glass or any plastic material. A preferred material is polypropylene.

The application device is preferably comprised by the housing, most preferably one application device is comprised, most preferably a nib. Preferably the application device is also in liquid communication with the reservoir, which allows for the most convenient delivery of the fabric treatment composition to the application device. In one preferred embodiment of the present invention the reservoir for the fabric treatment composition is provided in the form of a replaceable cartridge.

Such nib typically is a fibre-tip nib as commonly found in children's colouring pens or highlighting pens. A nib according to the present invention does preferably not comprise a single opening or channel to deliver the fabric treatment composition. Such an opening or channel does not allow for very controlled delivery of the fabric treatment composition. Hence, either insufficient composition will be delivered for effective cleaning or unnecessary large amounts of composition may be delivered, the latter leading to longer drying times for the treated fabric or in some cases possibly even to residues. Moreover, an opening or channel leading to the reservoir promotes the evaporation of volatile compounds of the composition stored therein and may further induce leaking when the fabric treatment applicator is transported. The same disadvantages are associated with a porous application device. Hence, a nib in accordance with the present invention preferably has a pore size of less than 300 $\mu$m. Preferably pores which may be present in a nib according to the present invention have a size from 1 $\mu$m to 200 $\mu$m, more preferably from 5 $\mu$m to 100 $\mu$m, more preferably from 10 $\mu$m to 50 $\mu$m.

Preferably the nib has a pointy shape, most preferably being cone- or wedge-shaped. A cone-shaped nib allows to exert pressure on a relatively narrow area, as benefical for mechanical stain removal, without leading to damage of the nib, which is thicker and hence more stable closer to the housing. A cone- or wedge-shaped nib also allows the fabric treatment composition to be applied to a small selected area as beneficial for low moistening of the fabric and low residues.

The nib should be in contact with the reservoir directly or indirectly so as to allow transfer of the fabric treatment composition to the nib during use. The nib may be made of any synthetic or man-made or natural materials such as felt, open cell foam, closed cell foams, polyethylene, nylon etc. A preferred material for the nib is felt, most preferably provided from synthetic fibres.

The nib while being held by the housing has a section external to the housing, this section preferably measures from 3.0 cm to 0.1 cm, more preferably from 1.0 cm to 0.25 cm, most preferably from 0.75 cm to 0.5 cm in length.

The contact area—measured as given below—between the application device and a flat surface preferably is from 0.25 $mm^2$ to 400 $mm^2$, more preferably from 1 $mm^2$ to 100 $mm^2$, most preferably from 4 $mm^2$ to 10 $mm^2$. Such a contact area ensures optimal mechanical stain removal and allows for application of the fabric treatment composition to small selected areas.

Preferred application devices according to the present invention also exhibit a certain delivery volume efficiency—measured as described below. The delivery volume efficiency is defined as the amount of fluid (ml) delivered to the fabric per unit time per unit area ($s^{-1}$ $mm^{-2}$). The right delivery volume efficiency ensures that a sufficient but not too high amount of fabric treatment composition is delivered giving the benefits of a sufficient and constant flow rate and further the benefit of avoiding drying out of the nib (10) or the reservoir in between uses. The delivery volume efficiency is preferably from 0.0005 ml $mm^{-2}$ $s^{-1}$ to 0.1 ml $mm^2$ $s^{-1}$ and more preferably from 0.001 ml $mm^{-2}$ $s^{-1}$ to 0.01 ml $mm^{-2}$ $s^{-1}$.

The applicator may also comprise a cap to prevent evaporation of the composition and to prevent any unattended contact of the application device with objects when not used.

Methods of Application

The use of any applicator with any composition disclosed herein will depend on the applicator itself and also on the object on which the applicator is to be used.

The compositions disclosed herein are intended for usage on any surface of a material in direct or indirect contact with the human body, which inter alia are all encompassed by the term fabric. Those surfaces are typically soft surfaces comprised by materials such as soft plastic materials, leather and textile fabrics. Textile fabrics namely are found in clothing, including shirts, ties, blouses, socks, skirts, trousers, jackets, underwear, watch straps etc.

Moreover these compositions can be used on fabrics comprised by carpets, curtains or upholstery and the like.

For a fabric treatment applicator comprising a housing and an application device, the cap covering the application device, if present, is removed before application. The application device is then brought into contact with a selected area of an fabric. For some application devices exertion of pressure may be needed to release the composition from the applicator. The pressure initially needed for this purpose may be higher than the pressure needed to ensure constant the flow of the composition. Wiping or otherwise moving the application device over the selected application area may also be required to deliver the composition to all parts of this area and may help to uniformly apply the composition. Rubbing, i.e. wiping while exerting pressure towards the fabric, may help in the mechanical removal of stains.

The application of any composition disclosed herein, may be one step of a more comprehensive treatment of a fabric. The treatment may for example comprise preparing steps, such as removing larger amounts of a stain inducing material, e.g. food, with a serviette or the like.

However, a stain removal treatment carried out with an applicator according to the present invention does not comprise a rinsing step for the removal of a stain. A rinsing step is not needed, since the fabric treatment applicators disclosed herein are highly efficient in removing any stains, including water soluble ones. Moreover, post-treatment of a fabric under running water or with a moist cloth is not required—neither as not to lease residues nor for mechanical removal of a stain—due to the effective mechanical removal of any stains by means of the disclosed application device and the residue free and fabric friendly treatment by the chemical compositions used.

Furthermore, an additional step such as a drying step is normally not needed, since the compositions disclosed herein promote quick drying and the applicators disclosed herein allow application of low amounts of a fabric treatment composition to small areas.

TEST METHODS

Dye Removal Test

An expert panel assists in visual grading. Thus, in one such test, swatches of fabric are individually dyed with a dye from a representative dye category such as from reactive dyes, sulphur dyes, vat dyes, direct dyes and azoic dyes. A swatch of fabric is prepared with a dye from each category. A measured area within each swatch is treated with the fabric treatment composition and allowed to dry. Any dye removal in the treated swatch is assessed visually by comparing the treated area of the swatch with the surrounding untreated area of the swatch. Numerical units ranging from: (0) 'no difference between both fabrics', (1) 'I think there is a difference', (2) 'I'm sure there is a difference', (3) 'there is a big difference', (4) 'there is a huge difference' are assigned by panelists. The test is repeated three times of any swatch and an average value is calculated.

Measurement of Frictional Stress

The application device is clamped to the load arm of a Plint dual axis reciprocating rig (such as model TE75R, MRPRA RUBBER CONSULTANTS). The angle of the fabric treatment applicator relative to the contact surface is adapted to maximise the contact area. Angles of the fabric treatment applicator relative to the contact surface for which the angle between the vertical axis of the fabric treatment applicator (a line connecting the centre of the contact area with the centre of mass of the fabric treatment applicator defines the vertical axis.) and the contact surface less than 45° are not considered (since they are not typical for a consumer preferred application method). The clamping arrangement provided a consumer realistic vertical load, R, on the application device of 3N. The coefficient of friction is then measured between the application device and a 100% cotton fabric as used in mens' shirts mounted on soft counter surface provided by a 2 mm thick sheet of soft rubber mounted with double sided adhesive to a flat aluminium plate. The application device is measured wet using a composition as given in Example 1. The coefficient of friction is measured over the central 10 mm of four traverses of 20 mm in both the forward and reverse direction at a speed of 1 mm $s^{-1}$ and an average value calculated. Measurements with the application device in final measuring position are repeated three times to check reproducibility.

Measurement of Contact Area

Measurements of the contact area of the application device are carried out with a fabric treatment applicator which contains a dry application device and no treatment composition. The dry application device is inked by pressing it against an ink stamp pad and then clamping the fabric treatment applicator to the load arm of a Plint dual axis reciprocating rig (such as model TE75R, MRPRA RUBBER CONSULTANTS). A mark on a contact surface which is representative of the contact area of the application device is obtained by controlled lowering and raising of the Plint load arm towards and away from the contact surface. The angle of the fabric treatment applicator relative to the contact surface is adapted to maximise the contact area. Angles of the fabric treatment applicator relative to the contact surface for which the angle between the vertical axis of the fabric treatment applicator (as defined above) and the contact surface less than 45° are not considered (since they are not typical for a consumer preferred application method). The contact time should be approximately 1 s while a 3N load should be applied on the application device. The contact area can then be calculated from the mean length and width of the mark determined using a magnifying lens with a graticule. Measurements with the application device in final measuring position are repeated three times to check reproducibility.

Measurement of Delivery Volume Efficiency

The application device is firmly inserted through the bottom of a standard liquid container (such as a 50 ml centrifuge tube available from Corning No. 25330-50). To ensure a secure arrangement, the size of the orifice through which the application device is inserted is cut to the size of the application device and a silicone based sealant used. This unit is then clamped into position beneath a compressor unit (such as a Lloyd LR5K Compression meter). This arrangement provides a consumer realistic vertical load of 3N. The application device is placed in contact with an absorbent pad comprised of a bicomponent synthetic fibre top layer above a fluffy pulp base layer. The pad allows rapid transport away from the point of delivery so as not to reduce the concentration gradient and hence reduce flow. The container is then filled with the stain removing solution (such as Example 1) to a level of 20 ml. The amount of fluid that flows per unit time is measured by noting the loss of fluid from the reservoir over a fixed period. The delivery volume efficiency is then calculated by normalising the flow rate with respect to the total surface area of contact ($mm^2$) between the application device and the fabric. Measurements are repeated three times to check reproducibility.

What is claimed is:

1. A fabric treatment applicator comprising an application device comprising a fibre-tip nib and a fabric treatment composition, the fabric treatment composition comprising hydrogen peroxide, a radical scavengers, a chelating agent, an alkyl sulphate or alkyl ethoxy sulfate surfactant, an organic solvent and water.

2. An applicator according to claim 1 wherein said application device has a frictional stress value from 0.05 N $mm^{-2}$ to 10 N $mm^{-2}$.

3. An applicator according to claim 1, wherein said composition comprises at least 70% of water and from about 1% to about 4% of butoxy propoxy propanol.

4. A method of removing a stain from fabric comprising the step of contacting said fabric with a the nib of a fabric treatment applicator according to claim 1 to apply said fabric treatment to said fabric, without rinsing said fabric treatment composition from said fabric.

5. A method according to claim 4 wherein said contact comprises rubbing and wherein said application device has a frictional stress value of from 0.05 N $mm^{-2}$ to 10 N $mm^{-2}$.

* * * * *